US011361923B2

(12) United States Patent
Chen et al.

(10) Patent No.: US 11,361,923 B2
(45) Date of Patent: Jun. 14, 2022

(54) CONTACTOR

(71) Applicant: Eaton Electrical Ltd., Suzhou (CN)

(72) Inventors: Zhenbo Chen, Suzhou (CN); Luming Zhang, Suzhou (CN); Guoyong Ping, Suzhou (CN); Zhengning Hu, Suzhou (CN)

(73) Assignee: EATON ELECTRICAL LTD., Suzhou (CN)

( * ) Notice: Subject to any disclaimer, the term of this patent is extended or adjusted under 35 U.S.C. 154(b) by 198 days.

(21) Appl. No.: 16/571,803

(22) Filed: Sep. 16, 2019

(65) Prior Publication Data

US 2020/0168418 A1 May 28, 2020

(30) Foreign Application Priority Data

Sep. 27, 2018 (CN) ..... 201821584441.0

(51) Int. Cl.
*H01H 3/00* (2006.01)
*H01H 50/04* (2006.01)
(Continued)

(52) U.S. Cl.
CPC ..... *H01H 50/045* (2013.01); *H01H 50/14* (2013.01); *H01H 50/18* (2013.01);
(Continued)

(58) Field of Classification Search
CPC ..... H01H 50/02; H01H 50/045; H01H 50/14; H01H 50/18; H01H 50/36; H01H 50/40;
(Continued)

(56) References Cited

U.S. PATENT DOCUMENTS 4,424,501 A * 1/1984 Goodrich ..... H01H 50/443 335/135
2003/0052760 A1* 3/2003 Smith ..... H01H 50/163 335/132

(Continued)

FOREIGN PATENT DOCUMENTS

CN 202363368 1/2012
CN 103094009 5/2013

(Continued)

OTHER PUBLICATIONS

EP Extended Search Report; corresponding application No. EP19200278.0; dated Jan. 10, 2020.

*Primary Examiner* — Shawki S Ismail
*Assistant Examiner* — Lisa N Homza
(74) *Attorney, Agent, or Firm* — Stanek Lemon Crouse & Meeks, P.A.

(57) ABSTRACT

The present utility model provides a contactor, comprising: a housing, including a first side plate and a second side plate disposed opposite to each other; a static iron core and a movable iron core located inside the housing, a coil bobbin fitted on the static iron core, a coil wound on the coil bobbin, an elastic device located between the coil bobbin and the movable iron core, and a moving contact and astatic contact disposed opposite to each other, wherein the coil bobbin includes a contact end surface facing the movable iron core and a first fixing part and a second fixing part fixed to edges of the contact end surface, length directions of the first fixing part and the second fixing part are parallel to the first side plate and the second side plate, the first fixing part is in contact with and connected to the first side plate, and the second fixing part is in contact with and connected to the second side plate. The contactor according to the present
(Continued)

utility model has a narrower width and saves installation space.

18 Claims, 7 Drawing Sheets

(51) Int. Cl.
*H01H 50/14* (2006.01)
*H01H 50/18* (2006.01)
*H01H 50/36* (2006.01)
*H01H 50/44* (2006.01)

(52) U.S. Cl.
CPC ..... *H01H 50/36* (2013.01); *H01H 50/44* (2013.01); *H01H 2050/446* (2013.01)

(58) Field of Classification Search
CPC ..... H01H 50/44; H01H 50/443; H01H 50/56; H01H 2050/046; H01H 2050/446
USPC ..... 335/192
See application file for complete search history.

(56) References Cited

U.S. PATENT DOCUMENTS

2003/0052761 A1* 3/2003 Smith ..... H01H 50/46 335/132
2003/0058070 A1* 3/2003 Smith ..... H01H 51/2209 335/132
2004/0130420 A1* 7/2004 Smith ..... H01H 50/163 335/132
2012/0188044 A1* 7/2012 Song ..... H01F 5/04 336/192
2015/0002247 A1* 1/2015 Rho ..... H01H 1/06 335/133
2015/0061797 A1* 3/2015 Yeon ..... H01H 50/541 335/194
2015/0109713 A1* 4/2015 Lee ..... H01H 50/543 361/206
2015/0130569 A1* 5/2015 Jang ..... H01H 47/00 335/192
2015/0179359 A1* 6/2015 Yeom ..... H01H 50/20 335/196
2016/0049273 A1* 2/2016 Jang ..... H01H 50/18 335/192
2016/0293366 A1 10/2016 Tsutsumi et al.
2020/0168418 A1* 5/2020 Chen ..... H01H 50/18

FOREIGN PATENT DOCUMENTS

CN 105990072 10/2016
CN 207883619 9/2018
DE 2408917 A1 6/1974
DE 3017561 11/1981

* cited by examiner

CONTACTOR

CROSS-REFERENCE TO RELATED APPLICATIONS

The present application claims priority to Chinese Patent Application No. 20182158444.1; filed Sep. 27, 2018, entitled CONTACTOR, the disclosure of which is incorporated herein by reference in its entirety.

TECHNICAL FIELD

The present utility model relates to a switching device, and in particular, to a contactor.

BACKGROUND

A contactor is an electrical apparatus used for connecting or disconnecting a circuit, and is commonly used in situations related to power, power distribution, and power utilization. A contactor includes an electromagnetic mechanism, a contact system, a transmission mechanism, a spring, a housing, and the like, among which electromagnetic mechanism is an important component. An electromagnetic mechanism includes a static iron core, a movable iron core, a coil bobbin fitted on the static iron core, and a coil wound on the coil bobbin. The principle of the electromagnetic mechanism is as follows: when the coil of the contactor is energized, a strong magnetic field is created, such that the static iron core generates a magnetic force to attract the movable iron core; the movable iron core drives contacts to act, causing a normally closed contact to open or a normally open contact to close. When the coil is deenergized, the magnetic force disappears. The movable iron core is released under the action of the spring, causing the contacts to recover, i.e., causing the normally closed contact to close or the normally open contact to open.

Existing 7-15 Amp contactors have a width of 45 millimeters. Due to the wide width and the large space they consume, existing contactors are unsuited in situations where the installation space is narrow.

SUMMARY OF THE UTILITY MODEL

In view of the aforementioned technical problem existing in the prior art, the present utility model provides a contactor, comprising: a housing, comprising a first side plate and a second side plate disposed opposite to each other, and a static iron core and a movable iron core located inside the housing, a coil bobbin fitted on the static iron core, a coil wound on the coil bobbin, an elastic device located between the coil bobbin and the movable iron core, and a moving contact and a static, contact disposed opposite to each other, wherein the coil bobbin comprises a contact end surface facing the movable iron core and a first fixing part and a second fixing part fixed to edges of the contact end surface, length directions of the first fixing part and the second fixing part are parallel to the first side plate and the second side plate, the first fixing part is in contact with and connected to the first side plate, and the second fixing part is in contact with and connected to the second side plate.

Preferably, the coil bobbin comprises: a bobbin body, the bobbin body comprising the contact end surface; a first connecting piece integrally formed with the first fixing part, one end of the first connecting piece extending out from the first fixing part; and a second connecting piece integrally formed with the second fixing part, one end of the second connecting piece extending out from the second fixing part.

Preferably, a side wall of the first fixing part is provided with a first positioning protrusion, and the first side plate has a side plate through-hole corresponding to the first positioning protrusion; a side wall of the second fixing part is provided with a second positioning protrusion, and the second side plate has a side plate through-hole corresponding to the second positioning protrusion.

Preferably, the side wall of the first fixing part is provided with two first positioning protrusions, the side wall of the second fixing part is provided with two second positioning protrusions, and a spacing between the two first positioning protrusions is unequal to a spacing between the two second positioning protrusions.

Preferably, the first side plate comprises a first sub-side plate and a second sub-side plate located on the same plane, the first sub-side plate has a slot and/or a fastener, and the second sub-side plate has a fastener and/or a slot engaged with the slot and/or the fastener of the first sub-side plate; the second side plate comprises a third sub-side plate and a fourth sub-side plate located on the same plane, the third sub-side plate has a slot and/or a fastener, and the fourth sub-side plate has a fastener and/or a slot engaged with the slot and/or the fastener of the third sub-side plate.

Preferably, the housing comprises an electrode top plate, the electrode top plate having a first expanded hole and a second expanded hole; the first fixing part and the second fixing part respectively have a first auxiliary bole and a second auxiliary hole; the contactor further comprises: a first auxiliary metal piece, one end of the first auxiliary metal piece being located in the first auxiliary hole, and the other end being located at an opening of the first expanded hole or extending out from the first expanded hole, and a second auxiliary metal piece, one, end of the second auxiliary metal piece being located in the second auxiliary hole, and the other end being located at an opening of the second expanded hole or extending out, from the second expanded hole.

Preferably, the elastic device is a spring, one end of the spring being abutted against the contact end surface of the coil bobbin, and the other end being in contact with the movable iron core.

Preferably, the contactor comprises an isolating plate located between the movable iron core and one end of the first connecting piece and an isolating plate located between the movable iron core and one end of the second connecting piece.

Preferably, one end of the first connecting piece has a threaded hole, and one end of the second connecting piece has a threaded hole.

Preferably, the contactor further comprises an auxiliary wiring module located outside the housing, two connection terminals of the auxiliary wiring module being respectively in contact with one end of the first connecting piece and one end of the second connecting piece.

Preferably, the contactor comprises: a supporting member fixedly connected to the movable iron core; four moving contacts fixedly connected to the supporting member, wherein an arrangement direction of the four moving contacts is perpendicular to the first side plate and the second side plate; and four sets of static contacts in one-to-one correspondence with the four moving contacts.

Preferably, the supporting member has a spring positioning pin extending toward the coil bobbin, the elastic device comprises a spring corresponding to the spring positioning pin, and one end of the spring is fixed to or fitted on the spring positioning pin, and the other end is abutted against the coil bobbin.

The contactor according to the present utility model has a narrower width, saves installation space, and is suitable for various situations where installation space is narrow

BRIEF DESCRIPTION OF THE DRAWINGS

Embodiments of the present utility model are further described below with reference to the accompanying drawings, in which.

DETAILED DESCRIPTION

To make objectives, technical solutions, and advantages of the present utility model clearer and more comprehensible, the present utility model is further described in detail below through specific embodiments with reference to the accompanying drawings.

Figure 1:
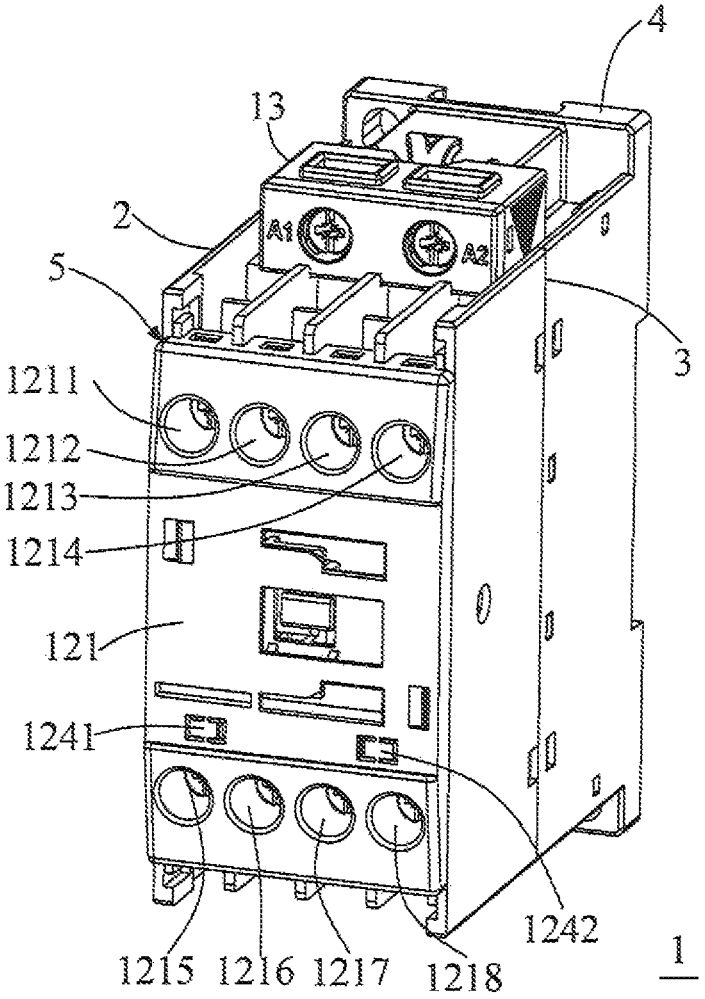
FIG. 1 is a schematic perspective view of a contactor according to a preferred embodiment of the present utility model.

FIG. 1 is a schematic perspective view of a contactor according to a preferred embodiment of the present utility model. As shown in FIG. 1, the contactor 1 includes a housing 5 and an auxiliary wiring module 13 located outside the housing 5. The housing 5 includes a side plate 2 and a side plate 3 disposed opposite to each other, as well as an electrode top plate 121 and a mounting bottom plate 4 disposed opposite to each other. The side plate 2, the side plate 3, the electrode top plate 121, and the mounting bottom plate 4 define a generally rectangular accommodation space. The distance between the side plate 2 and the side plate 3 is, the width of the contactor 1. Here, a direction perpendicular to the side plate 2 and the side plate 3 is defined as a width direction of the contactor 1.

The electrode top plate 121 is provided with eight electrode through-holes for electrode wires to pass through. The eight electrode through-holes are arranged into two rows, where four electrode through-holes 1211, 1212, 1213, 1214 in the first row are close to the auxiliary wiring module 13 and are arranged in succession in the width direction; the four electrode through-holes 1215, 1216, 1217, 1218 in the second row are similarly arranged in succession in the width direction. The electrode top plate 121 is further provided with an expanded hole 1241 and an expanded hole 1242. The expanded hole 1241 and the expanded hole 1242 are located between the first row of electrode through-holes and the second row of electrode through-holes.

Figure 2:
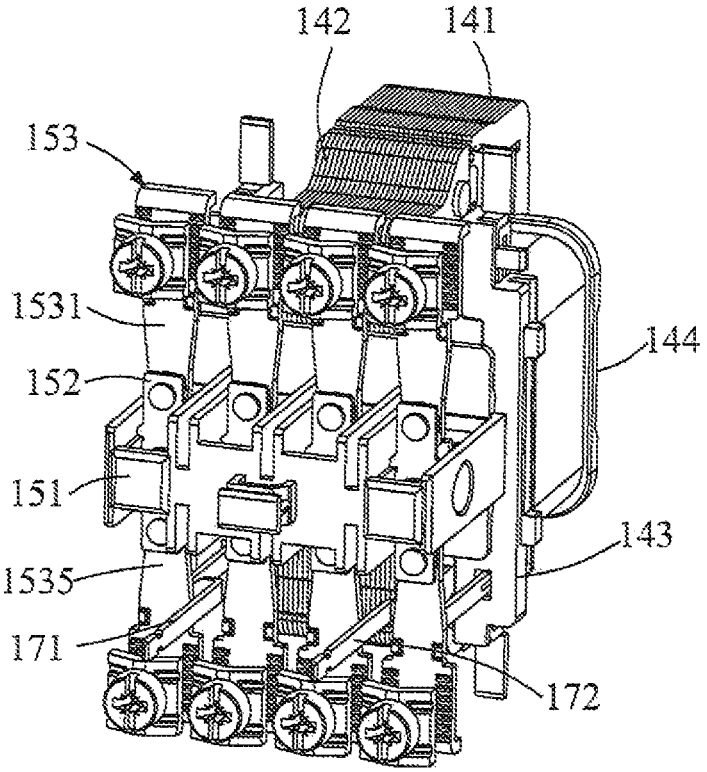
FIG. 2 is a schematic perspective view of the contactor shown in FIG. 1 with a housing and an auxiliary wiring module removed.

FIG. 2 is a schematic perspective view of the contactor shown in FIG. 1 with a housing and an auxiliary wiring module removed. As shown in FIG. 2, the contactor 1 further includes the following: a static iron core 141 located inside the housing 5; a movable iron core 142; a coil bobbin 143 fitted on the static iron core 141 and a coil 144 wound on the coil bobbin 143; a supporting member 151 fixedly connected to the movable iron core 142; four identical moving contacts 152 fixed to the supporting member 151 and arranged in the width direction; and four sets of identical static contacts 153 corresponding to the four moving contacts 152. The four moving contacts 152 and the four sets of static contacts 153 may employ moving contacts and static contacts in the prior art. The specific shape and structure thereof will not be described herein again.

Each moving contact 152 and a corresponding set of static contacts are used to achieve connection or disconnection clone electrode wire. Here, only one set of static contacts and one moving contact are used as an example for descriptive purposes. A set of static contacts 153 includes a static contact piece 1531 and a static contact piece 1535. One end of the static contact piece 1531 is disposed opposite to one end of one moving contact 152; the other end of the static contact piece 1531 corresponds to the electrode through-hole 1211 and is used for electrical connection to an electrode wire (not shown in FIG. 2) at the electrode through-hole 1211. One end of the static contact piece 1535 is disposed opposite to the other end of the moving contact 152; the other end of the static contact piece 1535 corresponds to the electrode through-hole 1215 and is used for electrical connection to an electrode wire (not shown in FIG. 2) at the electrode through-hole 1215.

Figure 3:
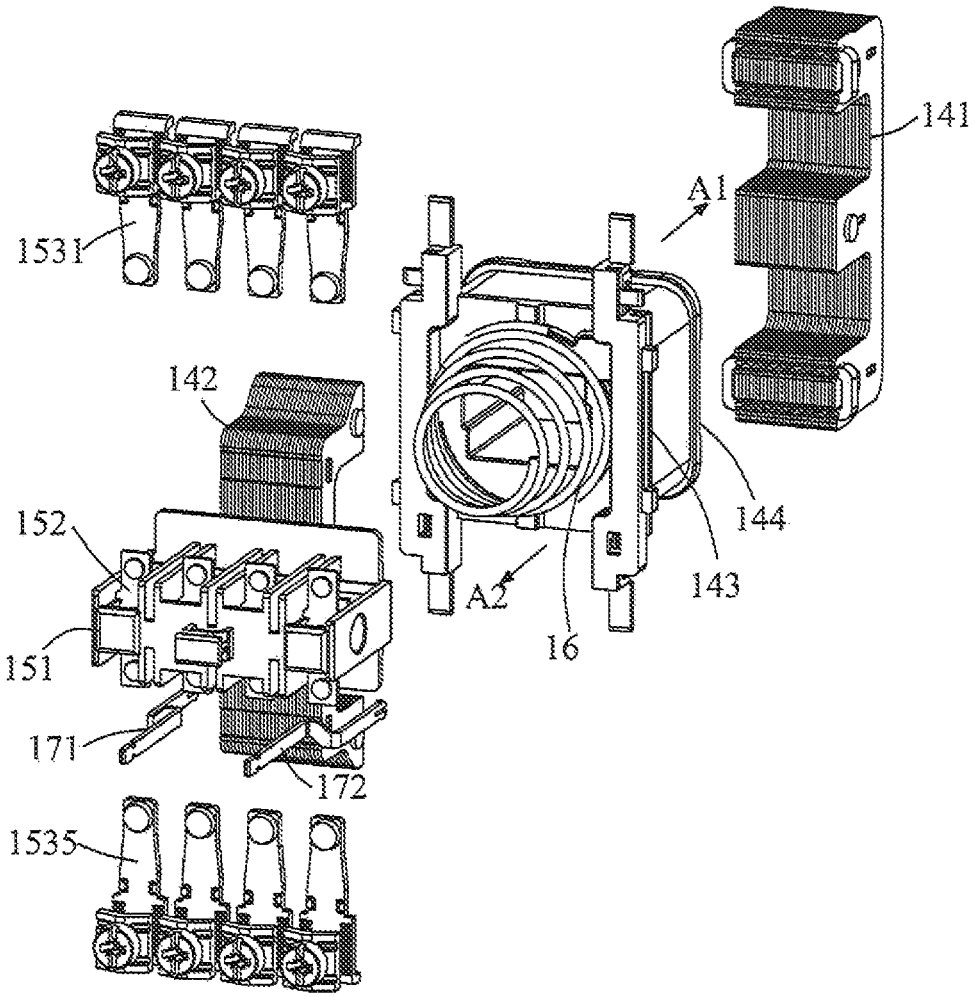
FIG. 3 is an exploded view of FIG. 2.

FIG. 3 is an exploded view of FIG. 2. As shown in FIG. 3, the contactor 1 further includes a spring 16 located between the movable iron core 142 and the coil bobbin 143. One end of the spring 16 is abutted against the coil bobbin 143, and the other end is configured to be abutted against the movable iron core 142 and apply to the movable iron core 142 a spring force in a direction, indicated by an arrow A2 in FIG. 3. When the coil 144 is not energized, the spring 16 applies a spring force to the movable iron core 142, so that the supporting member 151 fixedly connected to the movable iron core 142 is abutted against the inner side of the electrode top plate 121. At this time, the four moving contacts 152 fixed to the supporting member 151 are separated from the corresponding static contacts 153. When the coil 144 is energized, the static iron core 141 applies to the movable iron core 142 a magnetic force in a direction indicated by an arrow A1 (opposite to the direction indicated by the arrow A2). The movable iron core 142 is attracted by the static iron core 141 and drives the supporting member 151 and the four moving contacts 152 to approach the static iron core 141, so that the four moving contacts 152 are respectively in contact with the corresponding static contacts 153.

Figure 4:
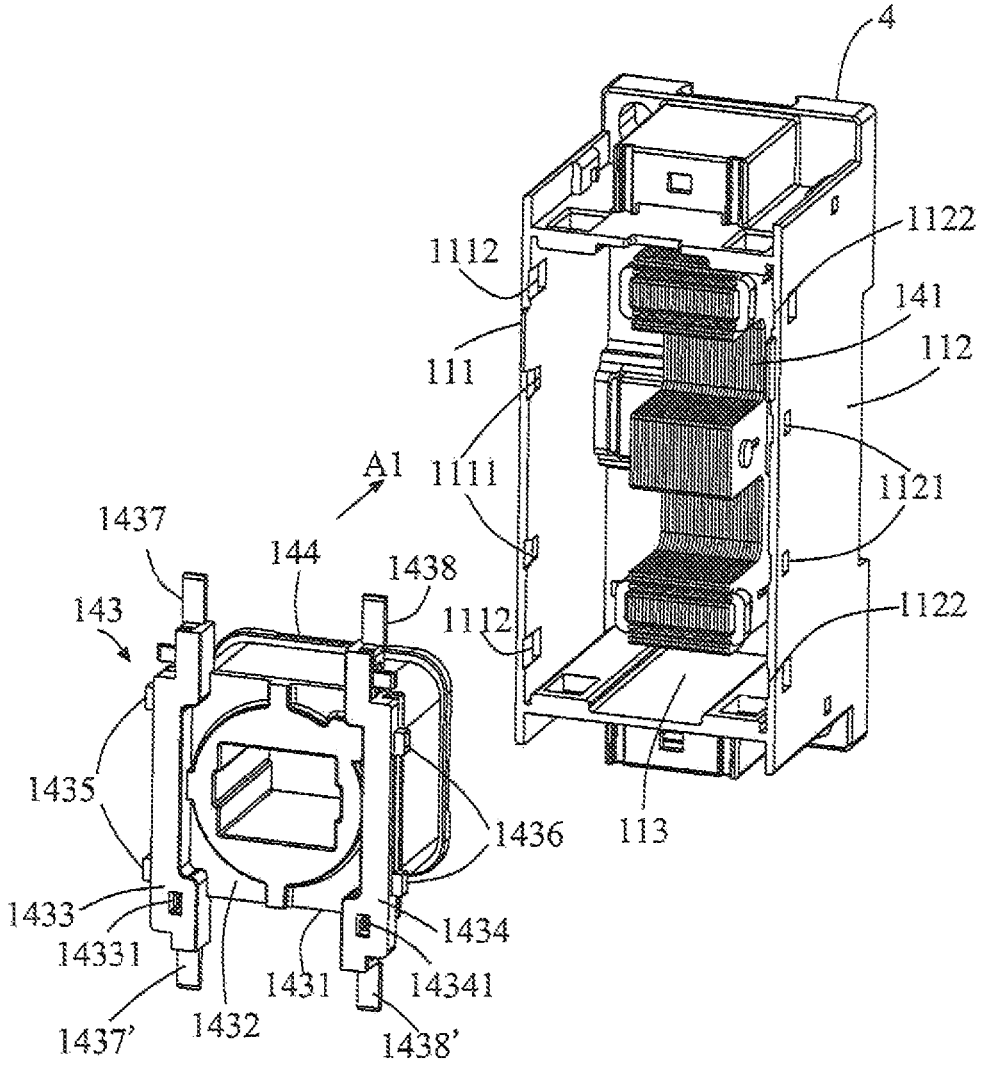
FIG. 4 is an exploded view of a static iron core, a coil bobbin, and a coil in FIG. 3, as well as a portion of the housing for accommodating the static non core, the coil bobbin, and the coil.

FIG. 4 is an exploded view of the static iron core, the coil bobbin, and the coil in FIG. 3, as well as a portion of the housing for accommodating the static iron core, the coil bobbin, and the coil. As shown in FIG. 4, a sub-side plate 111 of the side plate 2, a sub-side plate 112 of the side plate 3, and a mounting bottom plate 4 define a generally rectangular accommodation space 113. An edge of the sub-side plate 111 has two side plate through-holes 1111, and an edge of the sub side plate 112 has two side plate through-holes 1121. The spacing between the two side plate through-holes 1121 is less than the spacing between the two side plate through-holes 1111. The edge of the sub-side plate 111 further has two slots 1112, and the edge of the sub-side plate 112 further has two slots 1122.

The static iron core 141 is E-shaped, located in, the accommodation space 113, and is fixed to the inner side of the mounting bottom plate 4.

The coil bobbin 143 is integrally formed and includes a bobbin body 1431, a fixing part 1433, and a fixing part 1434. The bobbin body 1431 is generally annular column-shaped, and the middle thereof is provided with a bobbin through-hole matching in shape with a middle column of the static iron core 141. The bobbin body 1431 has a contact end surface 1432 facing the movable iron core 142 and the supporting member 151 (see FIG. 3) and a contact end surface (see FIG. 5 and FIG. 6) facing the static iron core 141 and the mounting bottom plate 4. One end of the spring 16 (see FIG. 3) is abutted against the contact end surface 1432. The fixing part 1433 and the fixing part 1434 are generally rod-shaped, and are respectively fixed to two opposite edges of the contact end surface 1432 of the bobbin body 1431, with length directions parallel to the sub-side plates 111 and 112. A side wall of the fixing part 1433 away from the bobbin through-hole (namely, close to the sub-side plate 111) is provided with two positioning protrusions 1435, the two positioning protrusions 1435 respectively correspond to the two side plate through-holes 1111, and the shape of the positioning protrusions 1435 matches the shape of the side plate through-holes 1111. Similarly, a side wall of the fixing part 1434 away from the bobbin through-hole (namely, close to the sub-side plate 112) is provided with two positioning protrusions 1436, the two positioning protrusions 1436 respectively correspond to the two side plate through-holes 1121, and the shape of the positioning protrusions 1436 matches the shape of the side plate through-holes 1121. The fixing part 1433 and the fixing part 1434 respectively have auxiliary holes 14331 and 14341. The auxiliary holes 14331 and 14341 open toward the electrode top plate 121 (see FIG. 1) and respectively correspond to the expanded hole 1241 and the expanded hole 1242 on the electrode top plate 121. When the coil bobbin 143 is fitted on the middle column of the static iron core 141, the two positioning protrusions 1435 are respectively located in the two side plate through-holes 1111, and meanwhile, the two positioning protrusions 1436 are respectively located in the two side plate through-holes 1121.

The coil bobbin 143 further includes a first connecting piece and a second connecting piece. The first connecting piece and the second connecting piece are made of a metal material, and are firmly fixed together with the fixing parts 1433 and 1434 by integral forming (for example, an injection molding process). The first connecting piece generally has the same shape as that of the fixing part 1433; only two ends 1437 and 1437' of the first connecting piece as shown in FIG. 4 extend out from two ends of the fixing part 1433; and one end 1437 of the first connecting piece is configured to be electrically connected to one connection terminal of the auxiliary wiring module 13. Similarly, the second connecting piece has generally the same shape as that of the fixing part 1434; two ends 1438 and 1438' of the second connecting piece extend out from two ends of the fixing part 1434; and one end 1438 is configured to be electrically connected to the other connection terminal of the auxiliary wiring module 13.

The coil 144 is wound on an outer side wall of the bobbin body 1431, and two ends of the coil 144 are respectively electrically connected to one end 1437 of the first connecting piece, and one end 1438 of the second connecting piece. The coil 144 can be conveniently energized by the auxiliary wiring module.

Please refer again to FIGS. 1 to 4. The contactor 1 further includes an auxiliary metal piece 171 and an auxiliary metal piece 172 (see FIGS. 2 and 3). One end of the auxiliary metal piece 171 is inserted into the auxiliary hole 14331 on the fixing part 1433 (see FIG. 4) and is in contact with the first connecting piece to attain electrical connection; the other end of the auxiliary metal piece. 171 is located at an opening of the expanded hole 1241 (sec FIG. 1). One end of the auxiliary metal piece 172 is inserted into the auxiliary hole 14341 on the fixing part 1434 (see FIG. 4) and is in contact with the second connecting piece to attain electrical connection; the other end of the auxiliary metal piece 172 is located at an opening of the expanded hole 1242 (see. FIG. 1).

Figure 5:
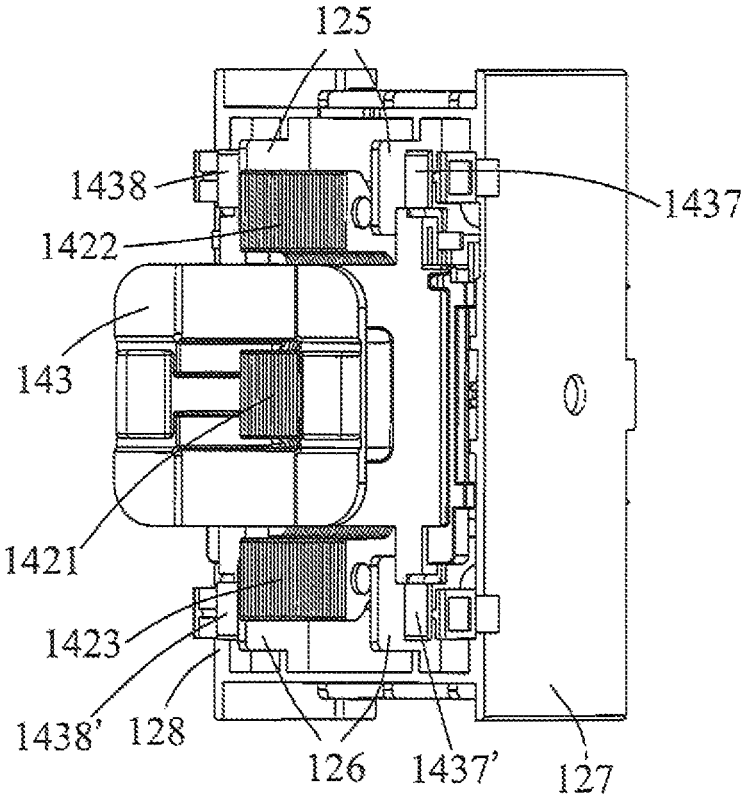
FIG. 5 is a schematic perspective view, seen from the rear of FIG. 1, of the contactor shown in FIG. 1 with the auxiliary wiring module, the static iron core, a mounting bottom plate, and a portion of side plates removed.

FIG. 5 is a schematic perspective view, seen from the rear of FIG. 1, of the contactor shown in FIG. 1 with the auxiliary wiring module, the static iron core, a mounting bottom plate, and a portion of side plates removed. As shown in FIG. 5, the side plate 2 further includes a sub-side plate 127 located on the same plane as the sub-side plate 111 thereof, and the side plate 3 further includes a sub-side plate 128 located on the same plane as the sub-side plate 112 of the side plate 3. The sub-side plate 127 of the side plate 2, the sub-side plate 128 of the side plate 3, and the electrode top plate 121 (not shown in FIG. 5) define a generally rectangular accommodation space. The movable iron core 142 and the moving contacts 152 fixedly connected to the supporting member 151 are located in the accommodation space. The movable iron core 142 is E-shaped and includes a middle column 1421, a side column 1422, and a side column 1423. The middle column 1421 of the movable iron core 142 is disposed opposite to the coil, bobbin 143, the side column 1422 of the movable iron core 142 is located between one end 1437 of the first connecting piece and one end 1438 of the second connecting piece, and the side column 1423 of the movable iron core 142 is located between the other end 1437' of the first connecting piece and the other end 1438' of the second connecting piece. The contactor 1 further includes two isolating plates 125 and two isolating plates 126 made of an insulating material. One isolating, plate 125 is located between the side column 1422 and one end 1437 of the first connecting piece, and the other isolating plate 125 is located between the side column 1422 and one end 1438 of the second connecting piece. One isolating plate 126 is located between the side column 1423 and the other end 1437' of the first connecting piece, and the other isolating plate 126 is located between the side column 1423 and the other end 1438' of the second connecting piece.

Figure 6:
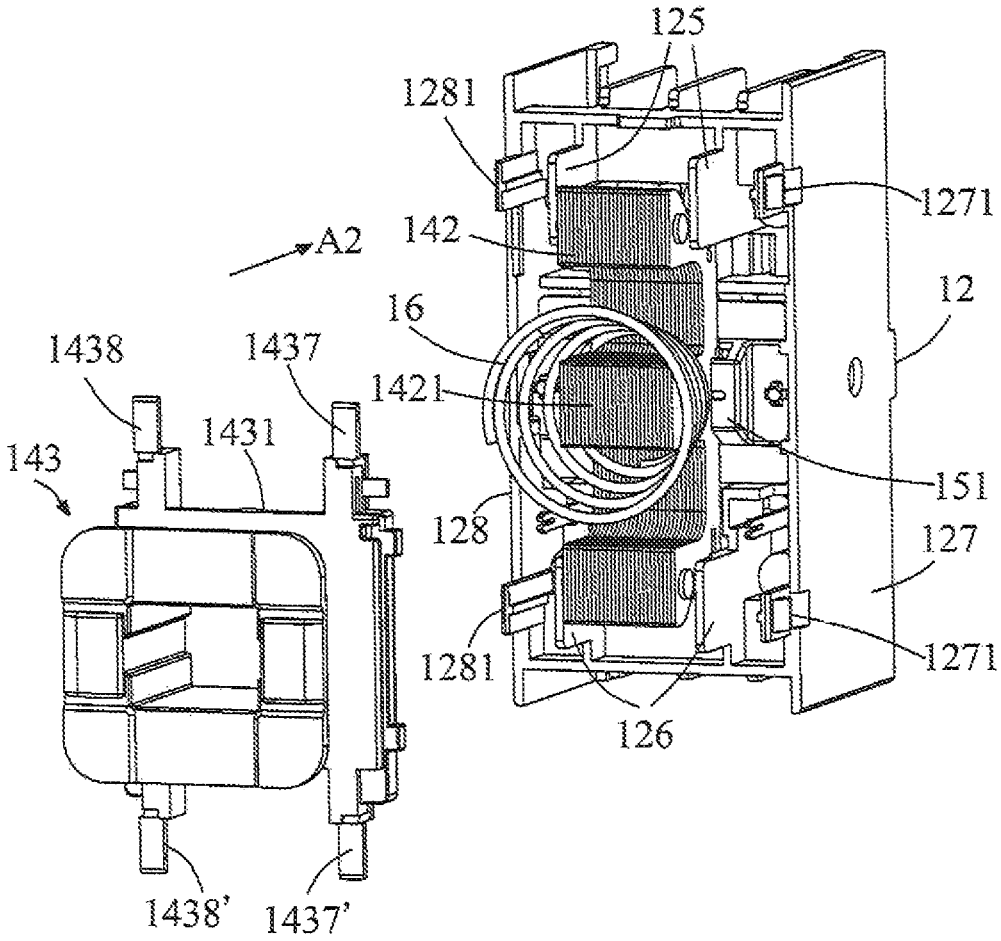
FIG. 6 is an exploded view of FIG. 5.

FIG. 6 is an exploded view of FIG. 5. The spring 16 is fitted on the middle column 1421 of the movable iron core 142 with one end abutted against the movable iron core 142 and the other end abutted against the contact end surface 1432 of the bobbin body 1431 (see FIG. 4). Therefore, the spring 16 applies to the movable iron core 142 a spring force in a direction indicated by an arrow A2. An edge of the sub-side plate 127 is provided with two fasteners 1271. The two fasteners 1271 are located on the same plane as the sub-side plate 127. The two fasteners 1271 correspond to and are suitable for engagement with the two slots 1112 of the sub-side plate 111. Similarly, an edge of the sub-side plate 128 is provided with two fasteners 1281. The two fasteners 1281 are located on the same plane as the sub-side plate 128. The two fasteners 1281 correspond to and are suitable for engagement with the two slots 1122 of the sub-side plate 112.

Figure 7:
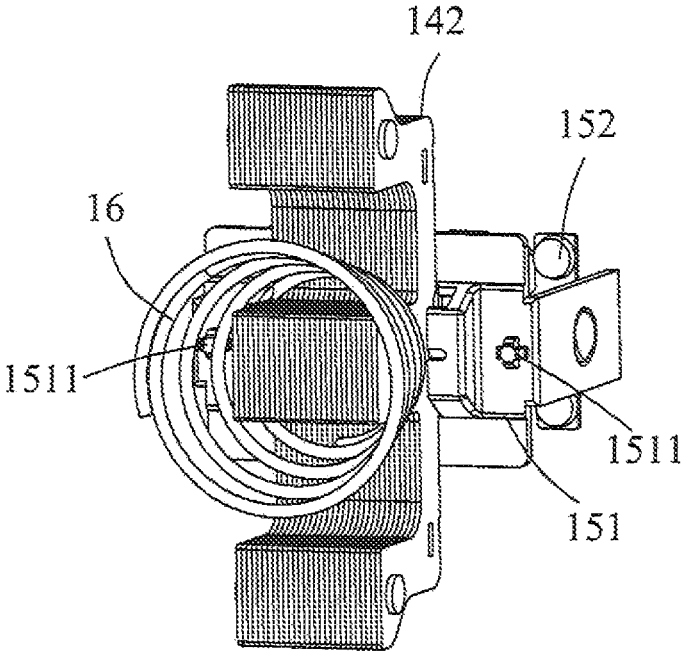
FIG. 7 is a schematic perspective view of a movable iron core, moving contacts, and a supporting member in FIG. 6 assembled together.

FIG. 7 is a schematic perspective view of the movable iron core, moving contacts, and a supporting member assembled together in FIG. 6. As shown in FIG. 7, the movable iron core 142 and the four moving contacts 152 (only one moving contact 152 is shown in FIG. 7) are fixed to the supporting member 151, so that the movable iron core 142, the supporting member 151, and the moving contacts 152 can move together. The manner of fixing and connecting the supporting member 151, the movable iron core 142, and the moving contacts 152 is not limited herein, and may be any fixing manner in the prior art, as long as it is ensured that the three can move together.

The supporting member 151 is further provided with two spring positioning pins 1511 extending toward the coil bobbin 143. In other embodiments of the present utility model, one end of a spring matching in size with the spring locating pin 1511 may further be fixed to or fined on the spring locating pin 1511, and the other end may be abutted against the coil bobbin 143, so that the spring applies a spring force to the supporting member 151, the movable iron core 142, and the moving contacts 152 to keep the movable iron core 142 away from the static iron ore 141. The quantity, shape, and size of the spring positioning pins 1511 are not limited in the present utility model.

The working principle of the contactor 1 is briefly described below. The coil 144 is energized by the auxiliary wiring module 13. The static iron core 141 generates a magnetic force and attracts the movable iron core 142. The movable iron core 142 simultaneously drives the supporting member 151 and the four moving contacts 152 to move toward the static iron core 141 (namely, in the direction indicated by the arrow A1), so that the four moving contacts 152 are respectively in contact with the four sets of static contacts 153 to attain electrical connection. The main circuit is thus in a connected state. When the main circuit needs to be disconnected, the current in the coil 144 is cut off, the static iron core 141 releases the movable iron, core 142, the spring 16 applies a spring force in the direction indicated by the arrow A2 to the movable iron core 142 and the supporting member 151, and the movable iron core 142 is kept away from the static iron core 141 so that the four moving contacts 152 are respectively separated from the four sets of static contacts 153. As a result, the main circuit is disconnected. Accordingly, the opening or closing of the four moving contacts 152 and the four sets of static contacts 153 is implemented.

The fixing parts 1433 and 1434 are disposed at two opposite edges of the contact end surface 1432 of the bobbin body 1431, and the length directions of the fixing parts 1433 and 1434 are parallel to the side plate 2 and the side plate 3 of the contactor 1 (namely, perpendicular to the width direction of the contactor 1). Thus, the size of the bobbin body 1431 in the width direction is not additionally increased.

The two positioning protrusions 1435 on the side wall of the fixing part 1433 are located in the side plate through-holes 1111 of the sub-side plate 111, and the two positioning protrusions 1436 on the side wall of the fixing, part 1434 are located in the side plate through-holes 1121 of the sub-side plate 112. The side plate 2 is in contact with and connected to the fixing part 1435, and the side plate 3 is in contact with and connected to the fixing part 1436. Adding a fixing and connecting component inside or outside the side plate 2 and the side plate 3 to fixedly mount the coil bobbin 143 inside the housing 5 is not necessary. The distance between the side plate 2 and the side plate 3 (namely, the width of the contactor 1) is designed to be consistent with the width of the coil bobbin 143, thereby producing a 4-pole contactor having a width of 36 millimeters and a current of 7 to 15 amperes.

The slots 1112 on the sub-side plate 111 of the side plate 2 are engaged with the fasteners 1271 on the sub-side plate 127 without the need to additionally provide a fixing and connecting device outside the sub-side plate 111 and the sub-side plate 127; similarly, the slots 1122 on the sub-side plate 112 of the side plate 3 are engaged with the fasteners 1281 on the sub-side plate 128 without the need to additionally provide a fixing and connecting device outside the sub-side plate 112 and the sub-side plate 128, thereby further reducing the width of the contactor 1.

The first connecting piece and the second connecting piece of the present utility model are integrally formed with the fixing parts 1433 and 1434. The installation process of the first connecting piece and the second connecting piece is omitted, and meanwhile, the first connecting piece and the second connecting piece are precisely and firmly fixed to the fixing parts 1433 and 1434. In addition, the present utility model does not require manufacturing various fixing and connecting components on the first connecting piece and the second connecting piece having a width of about 2 millimeters. Therefore, the first connecting piece and the second connecting piece have a simple manufacturing process.

On the coil bobbin 143, the spacing between the two positioning protrusions 1436 is different from the spacing between the two positioning protrusions 1435, thereby preventing mis-assembly of the coil bobbin 143.

The two isolating plates 125 increase the creepage distance between the side column 1422 of the movable iron core 142 and one end 1437 of the first connecting piece, and increase the creepage distance between the side column 1422 of the movable iron core 142 and one end 1438 of the second connecting piece. Similarly, the two isolating plates 126 increase the creepage distance between the side column 1423 of the movable iron core 142 and the other end 1437' of the first connecting piece, and increase the creepage distance between the side column 1423 of the movable iron core 142 and the other end 1438' of the second connecting piece. When a current is introduced between the first connecting piece and the second connecting piece, mis-operation of the moving contacts 152 due to short-circuit of the first connecting piece and the second connecting piece is avoided.

One ends of the auxiliary metal piece 171 and the auxiliary metal piece 172 are respectively electrically connected to the first connecting piece and the second connecting piece, and the other ends are located at openings of the expanded holes 1241 and 1242. Expandable ports of the contactor 1 are thus increased, and the monitoring and controlling of the current in the coil 144 is facilitated.

In other embodiments of the present utility model, the ends of the first connecting piece and the second connecting piece are provided with threaded holes suitable for electrical connection to power wires outside the contactor 1.

In other embodiments of the present utility model, the quantity of the positioning protrusions 1435 on the fixing part 1433 and the quantity of the side plate through-holes 1111 corresponding to the positioning protrusions 1435 may be more or less than two, and the quantity of the positioning protrusions 1436 on the fixing part 1434 and the quantity of the side plate through-holes 1121 corresponding to the positioning protrusions 1436 may be more or less than two.

In other embodiments, the spacing between the two positioning protrusions 1435 is less than or equal to the spacing between the two positioning protrusions 1436.

In other embodiments of the present utility model, the sub-side plate 127 of the side plate 2 has any quantity of fasteners and/or slots, and accordingly, the sub-side plate 111 has slots and/or fasteners engaged therewith. The sub-side plate 128 of the side plate 3 has any quantity of fasteners and/or slots, and accordingly, the sub-side plate 112 has slots and/or fasteners engaged therewith.

The present utility model is not intended to limit the shape of the spring 16, which may be a tower-shaped spring, a cylindrical spring, or the like.

In other embodiments of the present utility model, a plurality, of springs are employed in place of the spring 16 in the aforementioned embodiment; one ends of the plurality of springs are fixed to the spring positioning pins 1511, and the other ends are abutted against the contact end surface 1432 of the coil bobbin 143. Springs of appropriate quantity and specifications are selected according to the specifications and size of the contactor and the spring force required by the movable iron core. In other embodiments, other elastic devices may further be selected for applying a force to the movable iron core to keep it away from the static iron core.

In other embodiments of the present utility model, other magnetic cores such as EI-shaped, EF-shaped, and U-shaped magnetic cores are employed in place of the E-shaped magnetic cores in the aforementioned embodiment.

Although the present utility model has been described through preferred embodiments, the present utility model is not limited to the embodiments described herein, and further includes various changes and variations made without departing from the scope of the present utility model.

The invention claimed is:

1. A contactor, comprising:

a housing, comprising a first side plate and a second side plate disposed opposite to each other and an electrode top plate having a first expanded hole and a second expanded hole;

a static iron core and a movable iron core located inside the housing, a coil bobbin fitted on the static iron core, a coil wound on the coil bobbin, an elastic device located between the coil bobbin and the movable iron core, and a moving contact and a static contact disposed opposite to each other, wherein the coil bobbin comprises a contact end surface facing the movable iron core and a first fixing part and a second fixing part fixed to edges of the contact end surface, length directions of the first fixing part and the second fixing part are parallel to the first side plate and the second side plate, the first fixing part in contact with and connected to the first side plate and the second fixing part in contact with and connected to the second side plate, and the first fixing part and the second fixing part respectively having a first auxiliary hole and a second auxiliary hole;

a first auxiliary metal piece having a first end located in the first auxiliary hole and a second end located at the first expanded hole or extending out from the first expanded hole; and a second auxiliary metal piece having a first end located in the second auxiliary hole and a second end located at the second expanded hole or extending out from the second expanded hole.

2. The contactor according to claim 1, wherein the coil bobbin comprises:

a bobbin body, the bobbin body comprising the contact end surface;

a first connecting piece integrally formed with the first fixing part, one end of the first connecting piece extending out from the first fixing part; and a second connecting piece integrally formed with the second fixing part, one end of the second connecting piece extending out from the second fixing part.

3. The contactor according to claim 2, wherein the contactor comprises an isolating plate located between the movable iron core and one end of the first connecting piece and an isolating plate located between the movable iron core and one end of the second connecting piece.

4. The contactor according to claim 2, wherein the contactor further comprises an auxiliary wiring module located outside the housing, two connection terminals of the auxiliary wiring module being respectively in contact with one end of the first connecting piece and one end of the second connecting piece.

5. The contactor according to claim 1, wherein a side wall of the first fixing part is provided with a first positioning protrusion, the first side plate has a side plate through-hole corresponding to the first positioning protrusion, a side wall of the second fixing part is provided with a second positioning protrusion, and the second side plate has a side plate through-hole corresponding to the second positioning protrusion.

6. The contactor according to claim 5, wherein the side wall of the first fixing part is provided with two first positioning protrusions, the side wall of the second fixing part is provided with two second positioning protrusions, and a spacing between the two first positioning protrusions is unequal to a spacing between the two second positioning protrusions.

7. The contactor according to claim 1, wherein the first side plate comprises a first sub-side plate and a second sub-side plate located on the same plane, the first sub-side plate has a slot and/or a fastener, and the second sub-side plate has a fastener and/or a slot engaged with the slot and/or the fastener of the first sub-side plate; and the second side plate comprises a third sub-side plate and a fourth sub-side plate located on the same plane, the third sub-side plate has a slot and/or a fastener, and the fourth sub-side plate has a fastener and/or a slot engaged with the slot and/or the fastener of the third sub-side plate.

8. The contactor according to claim 1, wherein the elastic device is a spring, one end of the spring being abutted against the contact end surface of the coil bobbin, and the other end being in contact with the movable iron core.

9. The contactor according to claim 1, wherein the contactor comprises:

a supporting member fixedly connected to the movable iron core;

four moving contacts fixedly connected to the supporting member, wherein an arrangement direction of the four moving contacts is perpendicular to the first side plate and the second side plate; and four sets of static contacts in one-to-one correspondence with the four moving contacts.

10. The contactor according to claim 9, wherein the supporting member has a spring positioning pin extending toward the coil bobbin, the elastic device comprises a spring corresponding to the spring positioning pin, and one end of the spring is fixed to or fitted on the spring positioning pin, and the other end is abutted against the coil bobbin.

11. A contactor, comprising:

a housing;

a static core disposed in the housing;

a bobbin on the static core and having a coil disposed thereon, the bobbin having first and second fixing members extending laterally from respective first and second opposite sides of the bobbin to engage respective first and second walls of the housing and thereby retain the bobbin in the housing;

a moveable core in the housing, facing the static core and having a contact attached thereto;

a spring in the housing between the moveable core and the bobbin; and first and second auxiliary conductors electrically coupled to respective ones of the first and second fixing members and extending therefrom to first and second openings in a third wall of the housing that is perpendicular to the first and second walls.

12. The contactor of claim 11, wherein the bobbin comprises first and second conductive members disposed at the first and second sides of the bobbin and covered by respective first and second insulation regions and wherein the first and second fixing members comprise respective first and second protrusions of the first and second insulation regions.

13. The contactor of claim 12, wherein the first and second protrusions engage openings in respective ones of the first and second walls of the housing.

14. The contactor of claim 12, wherein the first fixing member comprises a plurality of spaced-apart first protrusions of the first insulation region and wherein the second fixing member comprises a plurality of spaced-apart second protrusions of the second insulation region.

15. The contactor of claim 12, wherein the first and second conductive members are electrically coupled to the coil.

16. The contactor of claim 12, wherein exposed ends of the first and second connectors extend from the first and second insulation regions.

17. The contactor of claim 12, wherein the first and second conductive members comprise respective first and second conductive bars and wherein the first and second protrusions extend perpendicularly with respect to the first and second conductive bars.

18. The contactor of claim 11, further comprising a stationary contact in the housing and wherein the moveable contact is configured to mate with the stationary contact.

* * * * *